US008887355B2

(12) United States Patent
Kleemann et al.

(10) Patent No.: US 8,887,355 B2
(45) Date of Patent: Nov. 18, 2014

(54) FASTENING ASSEMBLY FOR BUILT-IN REFRIGERATOR ON A SIDE WALL OF A FURNITURE BODY

(75) Inventors: Andreas Kleemann, Kalletal (DE); Alexander Goerz, Aalen (DE)

(73) Assignee: Hettich-Oni GmbH & Co. KG, Vlotho (DE)

( * ) Notice: Subject to any disclaimer, the term of this patent is extended or adjusted under 35 U.S.C. 154(b) by 0 days.

(21) Appl. No.: 14/111,005

(22) PCT Filed: Apr. 11, 2012

(86) PCT No.: PCT/EP2012/056535

§ 371 (c)(1), (2), (4) Date: Oct. 10, 2013

(87) PCT Pub. No.: WO2012/143273

PCT Pub. Date: Oct. 26, 2012

(65) Prior Publication Data

US 2014/0033478 A1 Feb. 6, 2014

(30) Foreign Application Priority Data

Apr. 18, 2011 (DE) ..... 10 2011 002 148

(51) Int. Cl.

| | |
|---|---|
| ***E05D 5/00*** | (2006.01) |
| ***F25D 23/08*** | (2006.01) |
| ***F25D 23/10*** | (2006.01) |
| ***E05D 5/04*** | (2006.01) |

(52) U.S. Cl.

CPC ..... *E05D 5/046* (2013.01); *F25D 23/08* (2013.01); *F25D 23/10* (2013.01)

USPC ..... 16/384; 16/247; 16/286; 16/387; 312/326; 312/405

(58) Field of Classification Search

CPC ..... E05D 3/142; E05D 5/046; E05D 7/04; E05D 7/0407; E05D 11/0054; E05Y 2900/21; E05Y 2900/31; F25D 23/028; F25D 2323/024; F25D 23/08; F25D 23/10

USPC ..... 16/247, 250, 251, 286–288, 382–384, 16/387, 388; 49/398; 312/405, 326

See application file for complete search history.

(56) References Cited

U.S. PATENT DOCUMENTS

| | | | | |
|---|---|---|---|---|
| 1,105,186 A * | 7/1914 | Crown | ..... | 16/251 |
| 2,154,716 A * | 4/1939 | Anderson | ..... | 16/247 |

(Continued)

FOREIGN PATENT DOCUMENTS

| | | |
|---|---|---|
| DE | 2 104 787 | 8/1971 |
| DE | 196 23 438 | 2/1997 |

(Continued)

*Primary Examiner* — William Miller

(74) *Attorney, Agent, or Firm* — Michael J. Striker

(57) ABSTRACT

A fastening assembly for a built-in refrigerator on a side wall of a furniture body includes a hinge with a hinge arm fixable on the refrigerator side, a screw-on flange with through holes for fastening screws, two fastening screws that pass through the through holes of the screw-on flange and that are screwed into a side wall of the furniture body and a wall thickness compensating plate. The wall thickness compensating plate is insertable if needed between the screw-on flange and the side wall. The fastening screws are preinstalled in a cover cap manufactured from plastic and pluggable onto the screw-on flange.

9 Claims, 11 Drawing Sheets

(56) References Cited

U.S. PATENT DOCUMENTS

| | | | | | |
|---|---|---|---|---|---|
| 3,229,323 | A | | 1/1966 | Hensgen | |
| 3,252,179 | A | * | 5/1966 | Watson | 16/250 |
| 3,568,221 | A | * | 3/1971 | Haldopoulos | 4/240 |
| 3,665,552 | A | | 5/1972 | Toldo et al. | |
| 3,768,117 | A | * | 10/1973 | Toldo et al. | 16/251 |
| 4,359,802 | A | * | 11/1982 | Rock | 16/238 |
| 4,411,045 | A | * | 10/1983 | Rock et al. | 16/243 |
| 4,626,049 | A | * | 12/1986 | Gross et al. | 312/291 |
| 4,639,971 | A | * | 2/1987 | Kurtz | 16/247 |
| 4,656,691 | A | * | 4/1987 | Allen | 16/251 |
| 4,837,893 | A | * | 6/1989 | Wilson | 16/240 |
| 5,471,709 | A | * | 12/1995 | Lanzani | 16/238 |
| 7,089,626 | B2 | * | 8/2006 | Alexander | 16/249 |
| 7,517,031 | B2 | * | 4/2009 | Laible | 312/406.2 |
| 8,511,768 | B2 | * | 8/2013 | Brachert | 312/405 |
| 2004/0222725 | A1 | * | 11/2004 | Park et al. | 312/405 |

FOREIGN PATENT DOCUMENTS

| | | | | |
|---|---|---|---|---|
| DE | 196 44 799 | | | 4/1998 |
| DE | 19935988 | A1 | * | 2/2001 |
| EP | 0 509 355 | | | 10/1992 |
| EP | 657609 | A1 | * | 6/1995 |
| EP | 0 707 185 | | | 4/1996 |
| EP | 934495 | B1 | * | 12/2001 |
| KR | 200457300 | Y1 | * | 12/2009 |

* cited by examiner

FASTENING ASSEMBLY FOR BUILT-IN REFRIGERATOR ON A SIDE WALL OF A FURNITURE BODY

CROSS-REFERENCE TO A RELATED APPLICATION

The invention described and claimed hereinbelow is also described in German patent Application 10 2011 002 148.5 filed on Apr. 18, 2011. This German Patent Application, whose subject matter is incorporated here by reference, provide the basis for a claim of priority of invention under 35 U.S.C. 119 (a)-(d).

BACKGROUND OF THE INVENTION

The present invention relates to a fastening assembly for a built-in refrigerator on a side wall of a furniture body, comprising a hinge having a hinge arm, which is fixed on the refrigerator side, having a screw-on flange having through holes for fastening screws, two fastening screws, which pass through the through holes of the screw-on flange and can be screwed into a side wall of the furniture body, and at least one wall thickness compensating plate, which can be inserted as needed between the screw-on flange and the side wall.

Fastening assemblies of the type according to the species are known per se and are used, in addition to further possibilities, to fix a built-in refrigerator in the interior of a furniture body, for fastening the built-in refrigerator to a side wall of the furniture body. Due to this fastening of the corresponding hinge arm, static stabilization of the hinge also additionally results, by means of which a door is connected to the built-in refrigerator.

Of course, two hinges with the capability of fastening a hinge arm to a side wall of a furniture body are used for the connection of a door to a built-in refrigerator. The fundamental construction and the mode of operation of these hinges and the fastening possibilities on a side wall are functionally identical, however.

In the case of the known fastening assemblies, the fastening screws and the at least one wall thickness compensating plate are provided as individual parts to an installer, i.e., an installer must successively insert the two fastening screws into the through holes of the screw-on flange and screw them into a side wall of a furniture body, the installer must possibly also place a wall thickness compensating plate between the screw-on flange and the side wall beforehand and hold it in place or fix it in another manner at least during the introduction of the fastening screws.

SUMMARY OF THE INVENTION

The present invention is based on the object of improving a fastening assembly of the type according to the species so as to reduce the required work steps for fixing a built-in refrigerator on a side wall of a furniture body and in particular also to simplify it for an installer.

This object is achieved according to the invention in that the fastening screws are preinstalled in a cover cap, which is manufactured from plastic and is pluggable onto the screw-on flange.

Because the fastening screws are preinstalled in the cover cap, the attachment thereof is substantially simplified. An installer only needs to plug the cover cap onto the screw-on flange and can firstly screw the preinstalled screws through the through holes of the screw-on flange and then into a side wall of a furniture body.

In a preferred exemplary embodiment of the invention, the at least one wall thickness compensating plate is formed integrally onto the cover cap via a film hinge or the like.

If a wall thickness compensating plate is required for structural reasons, it is already integrally formed onto the cover cap and only needs to be folded over in the direction of the rear side of the screw-on flange, without the danger existing that the wall thickness compensating plate will shift or fall out of the fastening region completely in an undesirable manner.

An embodiment of the invention is preferred in which the wall thickness compensating plate is provided with a catch pin, which can be clipped into a borehole of the screw-on flange.

In this way, particularly simple preliminary fixing of the wall thickness compensating plate is provided.

If a wall thickness compensating plate is not required, it can be removed readily by an installer by a cut along the film hinge and disposed of.

Further features of the invention are the subject matter of further subclaims.

Exemplary embodiments of the invention are illustrated in the appended drawings and will be described in greater detail hereafter.

DETAILED DESCRIPTION OF THE INVENTION

Figure 1:
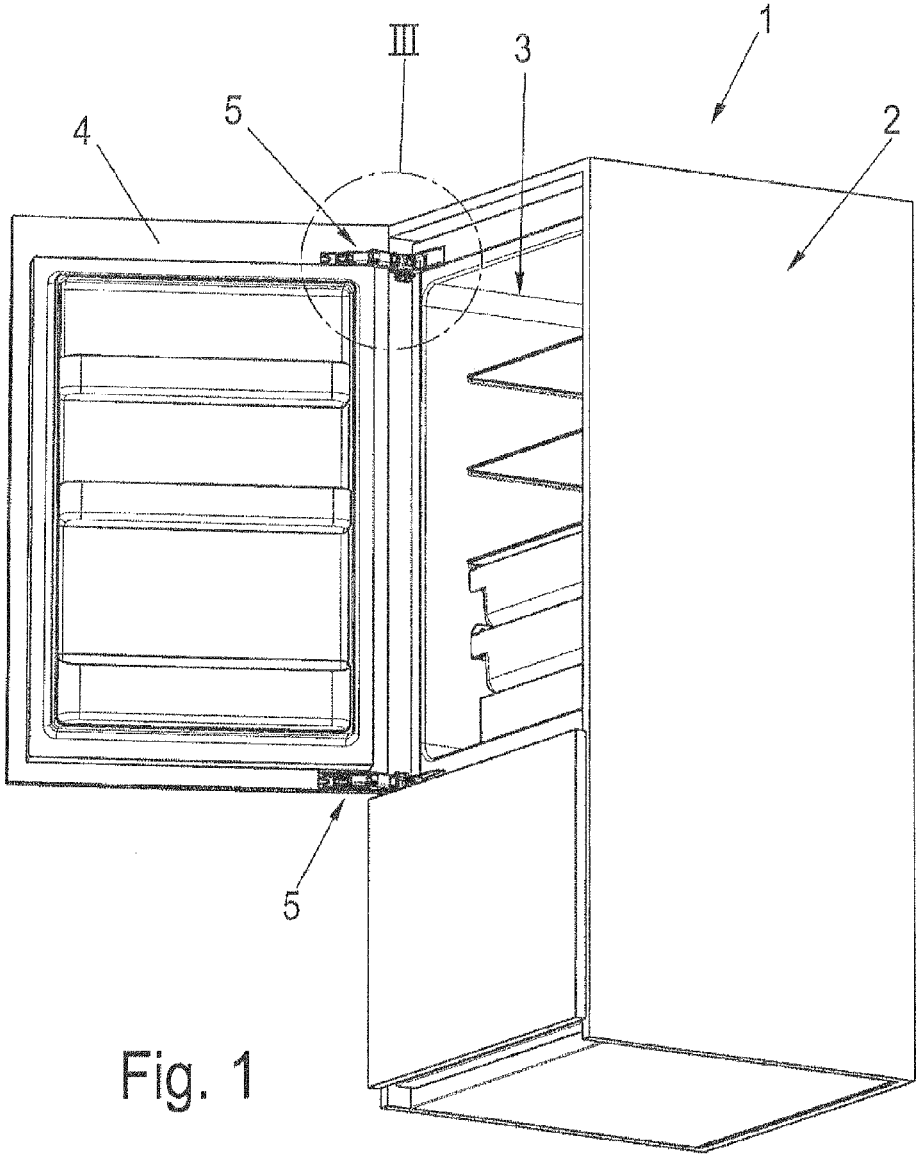
FIG. 1 shows a perspective view of a piece of furniture having a built-in refrigerator having open door
Figure 2:
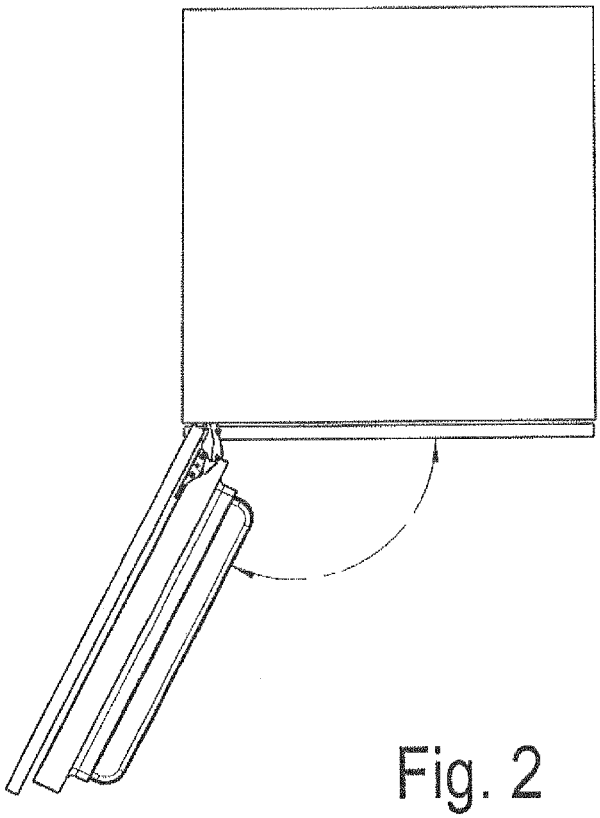
FIG. 2 shows a top view of the piece of furniture according to FIG. 1
Figure 3:
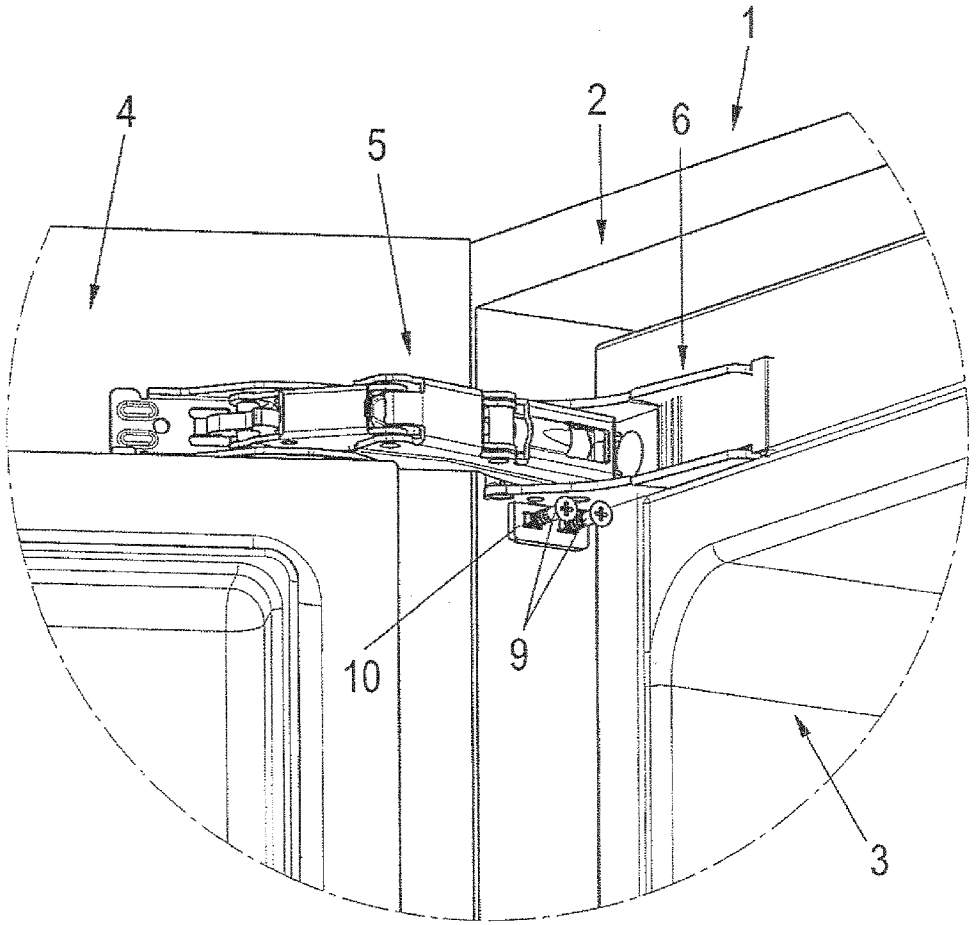
FIG. 3 shows an enlarged view of the detailed designated with III in FIG. 1

In FIGS. 1-3, a piece of furniture is designated as a whole with the reference sign 1, in the furniture body 2 of which a built-in refrigerator, which is designated as a whole with the reference sign 3, is installed. This built-in refrigerator 3 is equipped in a way known per se with a door 4, which is fixed via hinges 5 on the passage side.

Figure 4:
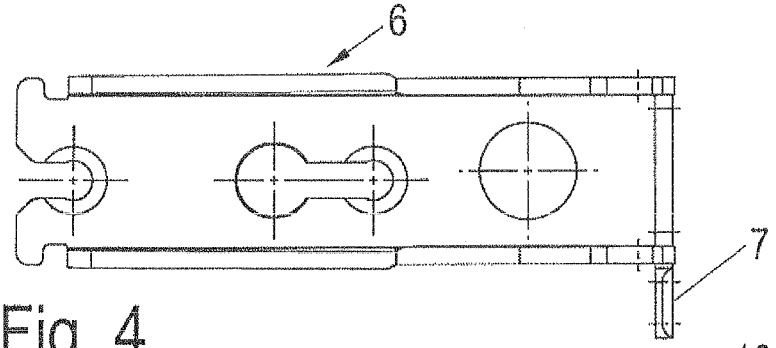
FIG. 4 shows a view of a hinge arm of a hinge of the built-in refrigerator
Figure 6:
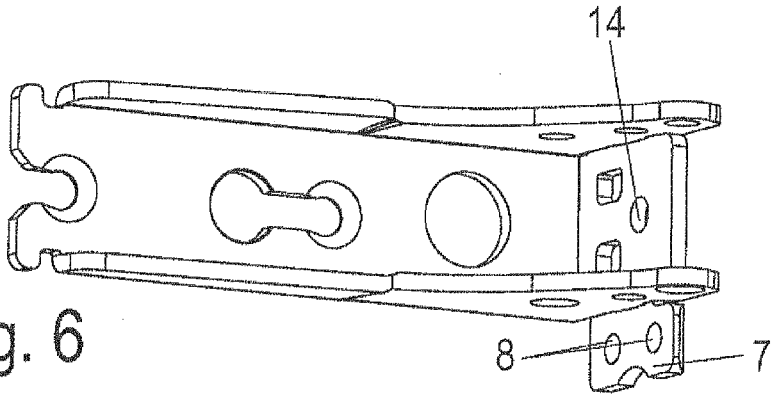
FIG. 6 shows a perspective view of the hinge arm according to FIG. 4
Figure 7:
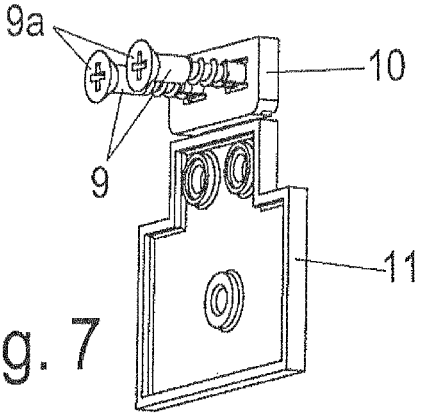
FIG. 7 shows a perspective view of the structural assembly according to FIG. 5
Figure 8:
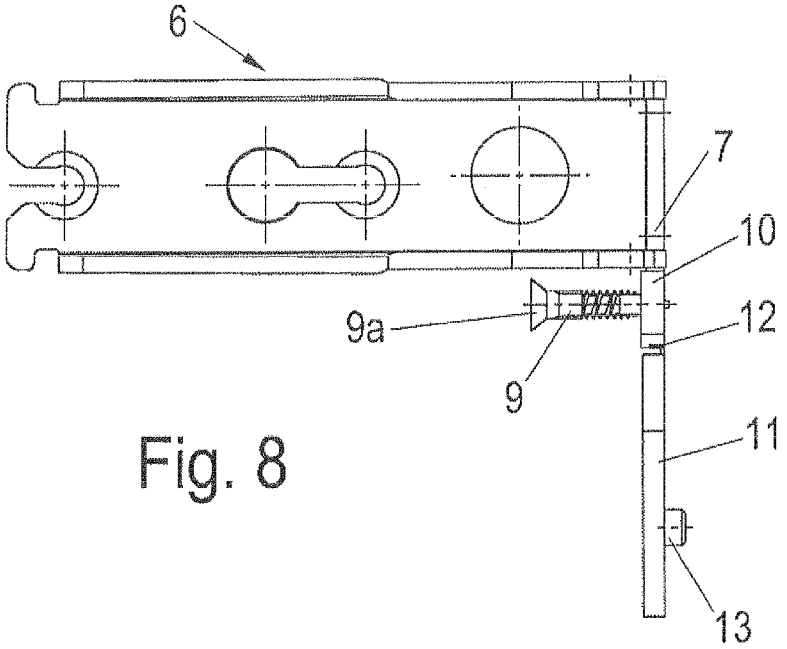
FIG. 8 shows a view corresponding to FIGS. 4 and 5 with the structural assembly according to FIG. 5 placed on the hinge arm
Figure 9:
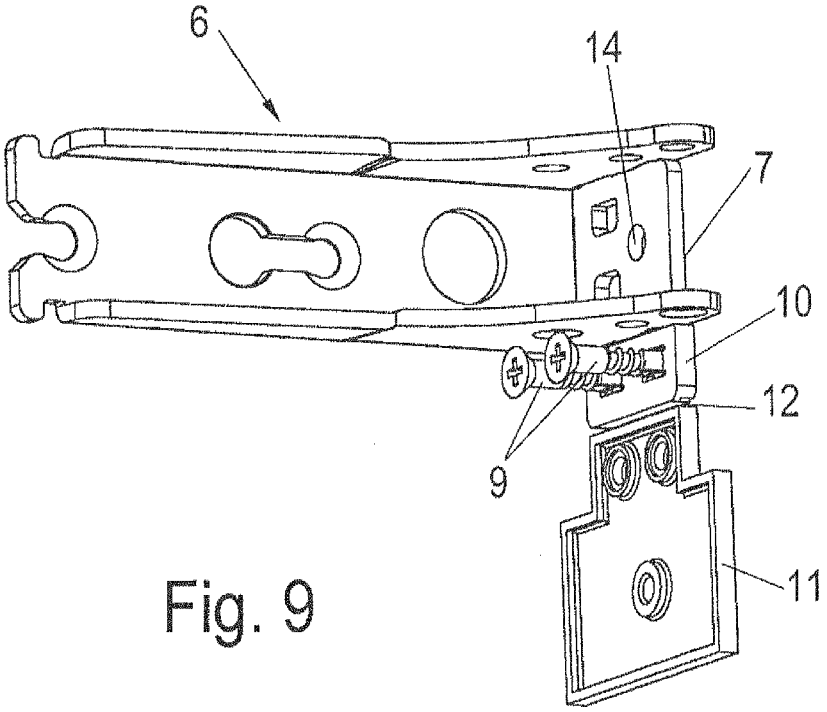
FIG. 9 shows a perspective view of the assembly according to FIG. 8
Figure 10:
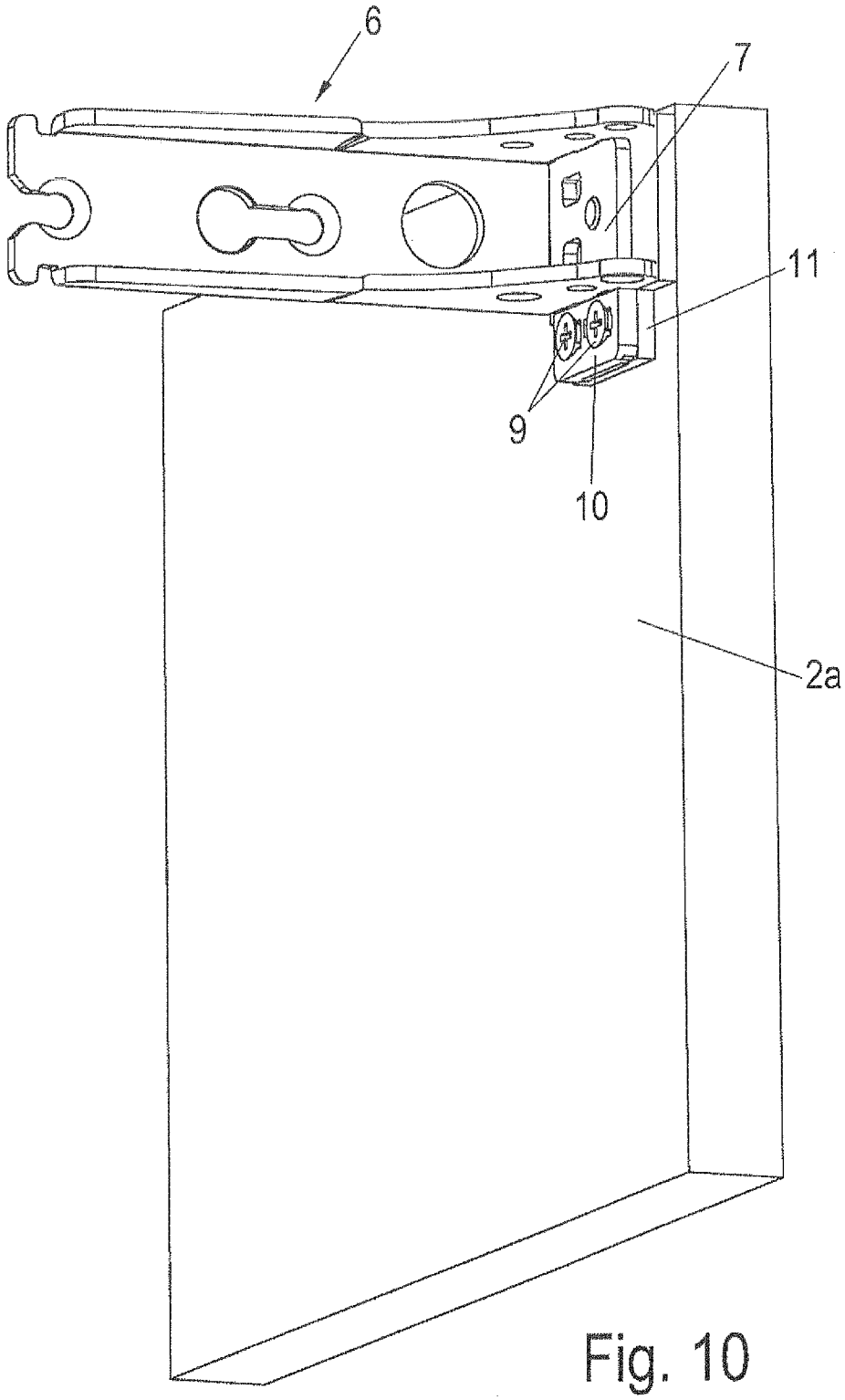
FIG. 10 shows a perspective view of the hinge arm in a state screwed onto a side wall of a furniture body

As is clearly shown in FIG. 3, each hinge 5 is equipped with a hinge arm 6, which is fixedly connected to the body of the refrigerator 3 in a way known per se (not shown in greater detail). This hinge arm 6 has, as clearly shown in FIGS. 4 and 6, for example, a screw-on flange 7 having through holes 8. Fastening screws 9 can be guided through these through holes 8 and screwed into a side wall 2*a* of the furniture body 2, wherein the fastening screws 9 are preinstalled in a cover cap 10, which is manufactured from plastic and is pluggable onto the screw-on flange 7. The term preinstalled is to be understood here to mean that the fastening screws 9 are inserted captively into corresponding breakthrough regions of the cover cap 10. For example, the fastening screws 9 can be held in a friction-locked manner in the breakthrough regions. The axial spacing of the fastening screws 9 is exactly adapted by the pre-finished breakthrough regions to the axial spacing of the two passage holes 8 within the screw-on flange 7.

The cover cap 10 itself can also be preinstalled on the screw-on flange by simple plugging, for example. Catch lugs, undercuts, or other plug connections known from the prior art are possible here.

Figure 5:
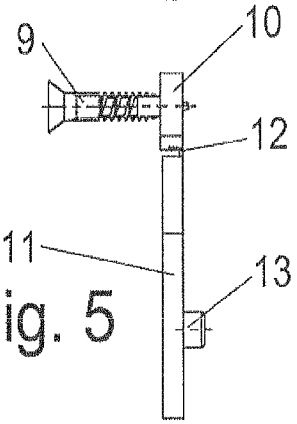
FIG. 5 shows a view of a cover cap having preinstalled fastening screws and a molded-on wall thickness compensating plate

A wall thickness compensating plate 11 is integrally connected via a film hinge 12 to the cover cap 10 manufactured from plastic, as shown very clearly in FIG. 5, for example.

The above-described components overall form a fastening assembly, by means of which the built-in refrigerator 3 is fastenable on a side wall 2*a* of a furniture body 2. After the insertion of a built-in refrigerator 3 into the body 2 of the furniture 1, an installer can plug the cover cap 10 having the preinstalled fastening screws 9 onto the screw-on flange 7 and screw the fastening screws 9 through the through holes 8 of the screw-on flange 7 into a side wall 2*a* of the furniture body 2.

The above-mentioned wall thickness compensating plate 11 is required, for example, if the side wall has a lesser thickness than the side walls conventionally used in furniture construction. In general, wall thicknesses of 19 mm are used in furniture construction. However, many producers are also passing over to using significantly lower wall thicknesses for reasons of cost and weight. In such a case, a wall thickness compensating plate 11 is then necessary, since the dimensions of the hinge arm 6 are adapted to the typical wall thicknesses of 19 mm.

The wall thickness compensating plate 11 can be folded over in this case around the film hinge 12 onto the screw-on flange 7 or onto its rear side, and therefore lies between the screw-on flange 7 and a side wall 2*a* of a furniture body 2. It is preferable for the wall thickness compensating plate 11 to be provided with a catch pin 13, which can be clipped into a corresponding borehole 14 of the screw-on flange 7.

A thickness of the wall thickness compensating plate 11 of up to 5 mm is preferred for the above-mentioned reasons. The wall thickness compensating plate 11 can also be thicker than 5 mm if needed, however.

Figure 11:
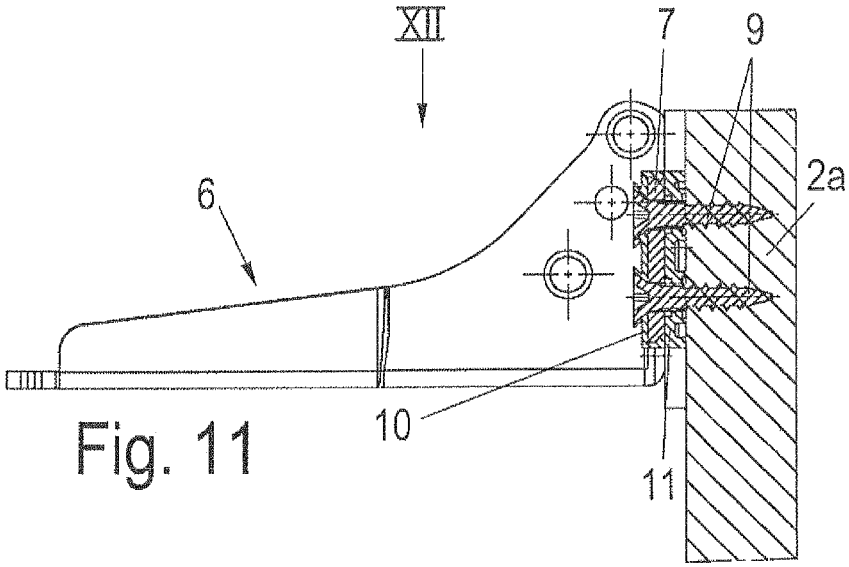
FIG. 11 shows a horizontal section through the fastening region of the hinge arm on the side wall
Figure 12:
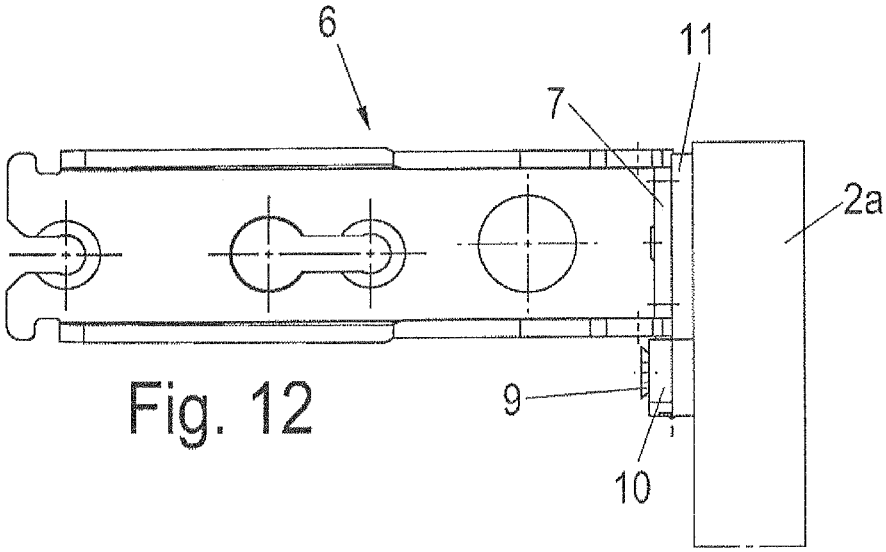
FIG. 12 shows a view in the direction of arrow XII in FIG. 11
Figure 13:
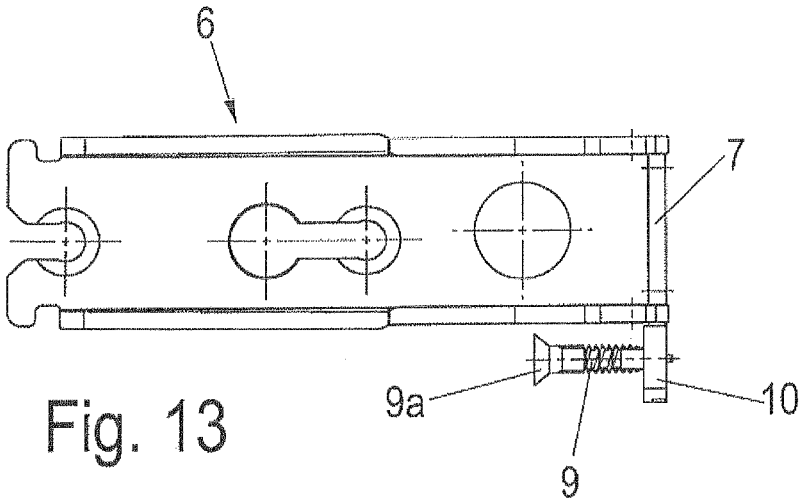
FIG. 13 shows a view corresponding to FIG. 8 of a hinge arm having a preinstalled cover cap after removal of the wall thickness compensating plate, which is still recognizable in FIG. 5, for example
Figure 14:
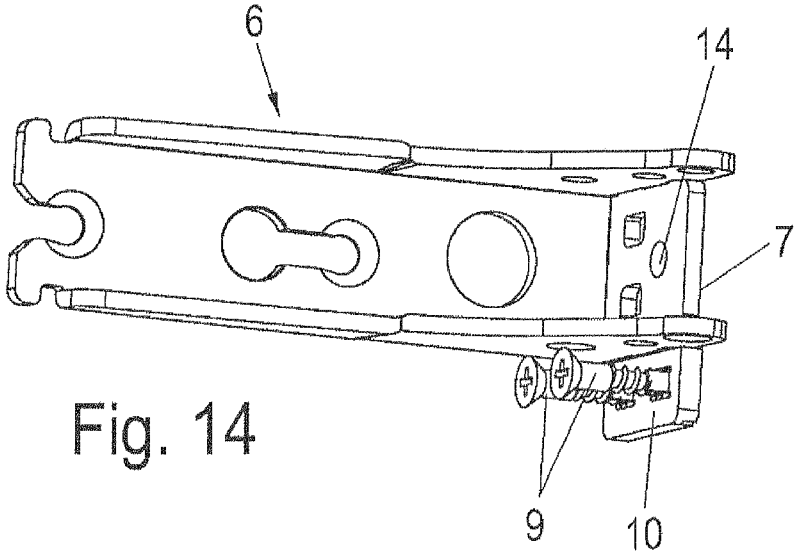
FIG. 14 shows a perspective view of the assembly according to FIG. 13
Figure 15:
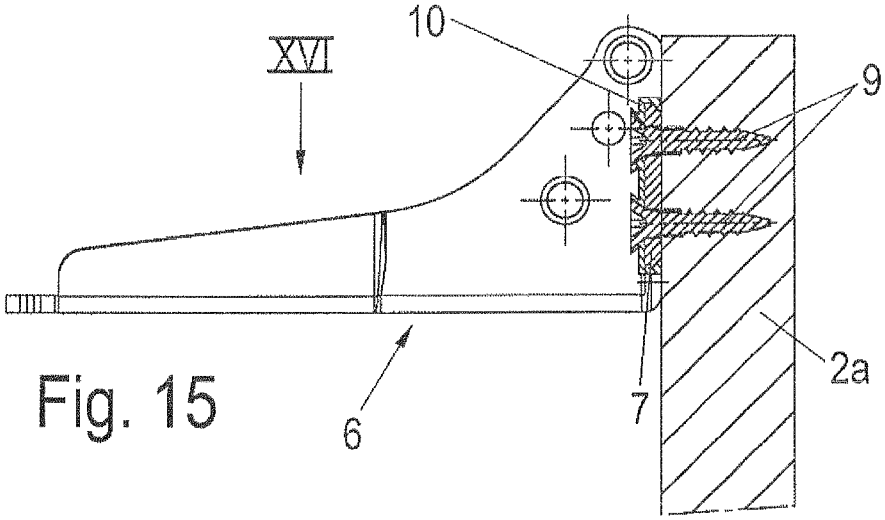
FIG. 15 shows a sectional view corresponding to FIG. 11 through the fastening region of the hinge arm according to FIGS. 13 and 14
Figure 16:
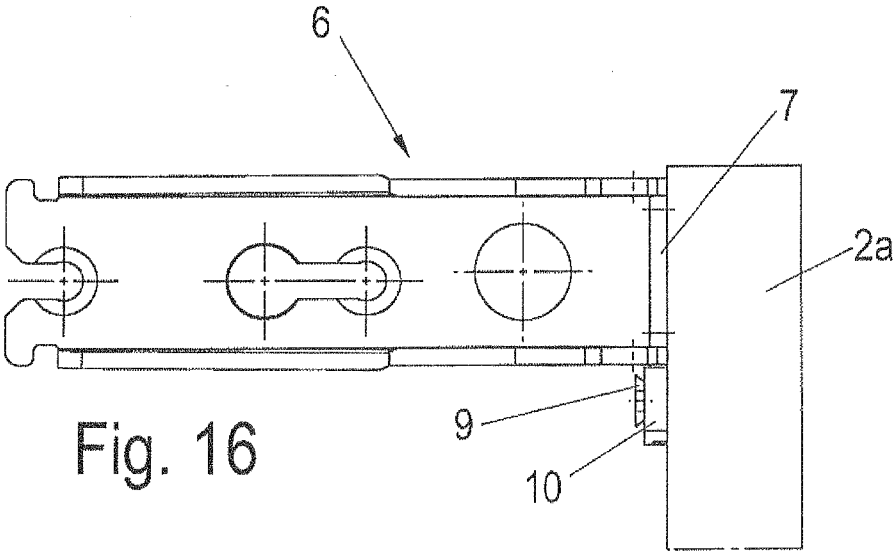
FIG. 16 shows a view in the direction of arrow XVI in FIG. 15
Figure 17:
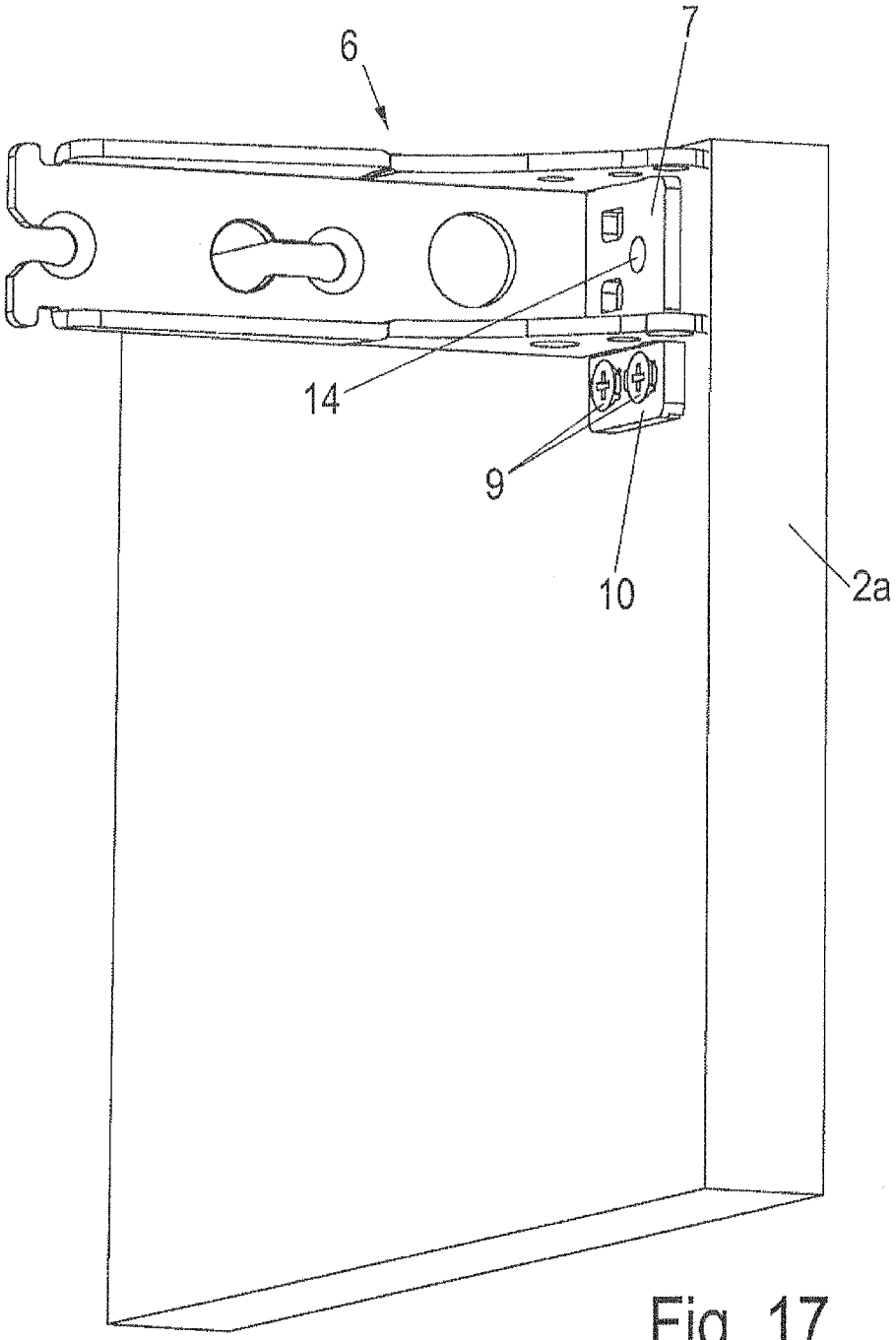
FIG. 17 shows a perspective view corresponding to FIG. 10 of the hinge arm, which is fastened on a side wall, according to FIGS. 13-16

The fastening screws 9 are screws having a countersunk head 9*a*. These countersunk heads 9*a* are pressed through the cover cap 10 directly up to the peripheral edges of the passage boreholes 8 while deforming the breakthrough regions of the cover cap 10, as is recognizable in FIG. 11 or 15, for example.

The mechanical carrying capacity of the cover cap 10 is therefore not significant for the carrying capacity of the connection.

If the wall thickness compensating plate 11, which is shown in FIGS. 4-12 and is also inserted between the screw-on flange 7 and the side wall 2*a* in the installed state, is not needed, it can be easily cut off of the cover cap 10 along the film hinge 12 and disposed of. The use of this form is shown in FIGS. 13-17.

Thus, if a built-in refrigerator 3 is to be fixed on a side wall 2*a* in the specified way in the interior of a furniture body 2, only a few actions and work steps are necessary for an installer for this purpose. The cover cap 10 having the preinstalled fastening screws 9 is plugged on to the screw-on flange 7, the fastening screws 9 are screwed into the side wall 2*a*, wherein optionally the wall thickness compensating plate 11 was previously moved into the region between screw-on flange 7 and side wall 2*a* by folding over around the film hinge 12.

A significant simplification and shortening of the installation effort therefore results with respect to the previous construction.

Beyond the illustrated exemplary embodiments, it is also conceivable to mold a further wall thickness compensating plate 11 onto a first wall thickness compensating plate 11 via a film hinge, wherein in this case both wall thickness compensating plates have a thickness of 1.5 mm, for example. The wall thickness compensating plate 11 located remotely from the cover cap 10 can now, under the presumption that the entire thickness of both wall thickness compensating plates 11 will be needed, be folded over beforehand onto the front side of the wall thickness compensating plate 11 connected to the cover cap 10 and latched thereon and subsequently the wall thickness compensating plate 11 doubled in this manner can be clipped via the catch pin 13 into the borehole 14 of the screw-on flange 7.

Figure 18:
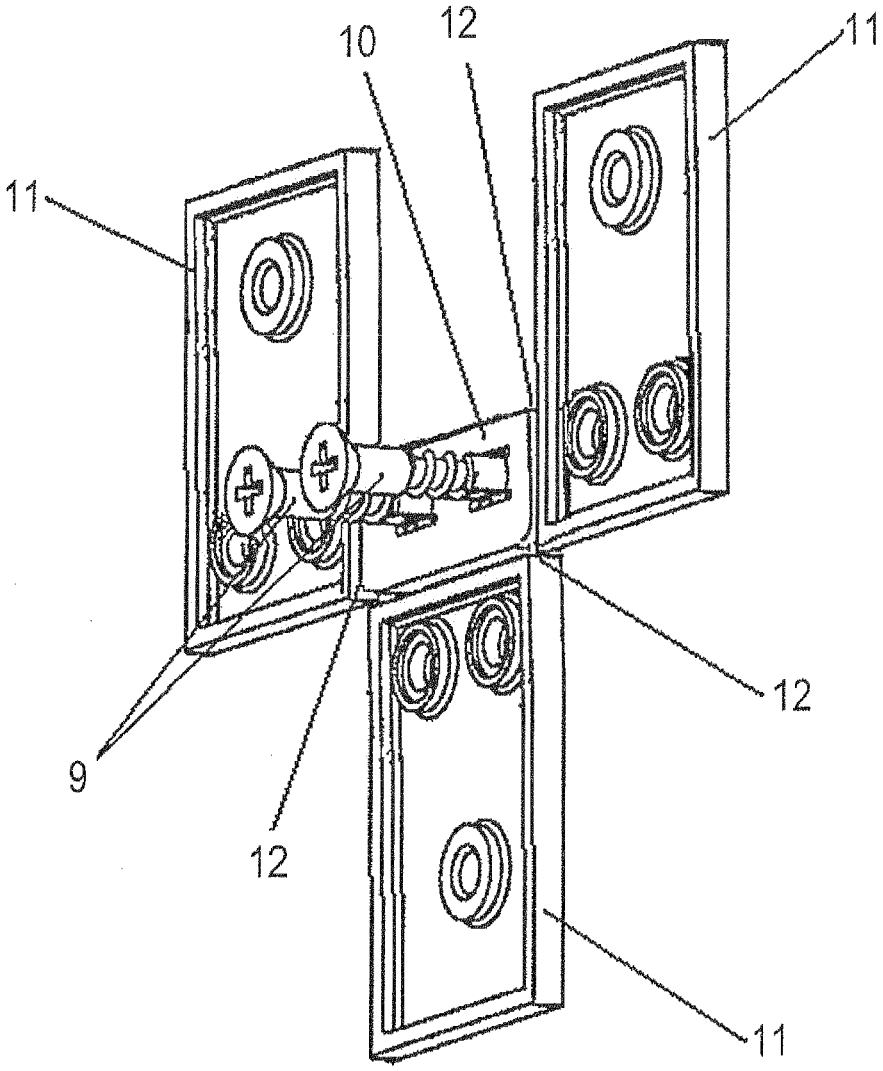
FIG. 18 shows a perspective view of a further exemplary embodiment of a cover cap having molded-on wall thickness compensating plate.

Still a further embodiment is shown in FIG. 18, in which three wall thickness compensating plates 11 are injection-molded onto the cover cap 10. The three wall thickness compensating plates 11 can have equal or also different thicknesses, to be able to achieve different dimensions for nearly any usage case.

Furthermore, beyond the illustrated exemplary embodiments, it is also conceivable that the screw-on flange 7 is molded onto the hinge arm 6 in such a manner that a built-in refrigerator is fastenable by means of such a fastening assembly onto the ceiling or floor wall of a furniture body. The built-in refrigerator could also be provided with a flap to be opened to the top or to the bottom, however, so that the fastening assembly would have a different built-in position than that shown. Therefore, the term side wall is to be understood in the scope of the present invention as also including the ceiling wall or floor wall.

LIST OF REFERENCE NUMERALS

1 furniture
2 furniture body
2*a* side wall
3 built-in refrigerator
4 door
5 hinge

6 hinge arm
7 screw-on flange
8 through hole
9 fastening screw
9*a* countersunk head
10 cover cap
11 wall thickness compensating plate
12 film hinge
13 catch pin
14 borehole

What is claimed is:

1. A fastening assembly for a built-in refrigerator (3) on a side wall (2*a*) of a furniture body (2), comprising:

a hinge (5) having a hinge arm (6), which is fixable on a refrigerator side, a screw-on flange (7) having through holes (8) for fastening screws (9), wherein two of the fastening screws (9) pass through the through holes (8) of the screw-on flange (7), and are screwed into the side wall (2*a*) of the furniture body (2), and at least one wall thickness compensating plate (11), which is insertable if between the screw-on flange (7) and the side wall (2*a*), wherein the fastening screws (9) are preinstalled in a cover cap (10), which is manufactured from plastic and plugs onto the screw-on flange (7).

2. The fastening assembly according to claim 1, wherein the at least one wall thickness compensating plate (11) is integrally molded via a film hinge (12) to the cover cap (10).

3. The fastening assembly according to claim 1, wherein the at least one wall thickness compensating plate (11) is provided with a catch pin (13), which is clipped into a borehole (14) of the screw-on flange (7).

4. The fastening assembly according to one of claim 1, wherein the fastening screws (9) are provided with countersunk heads (10), which are pressed directly onto the edges of through holes (8) of the screw-on flange (7) while deforming breakthrough regions of the cover cap (10).

5. The fastening assembly according to claim 1, wherein the thickness of the at least one wall thickness compensating plate (11) is less than 5 mm.

6. The fastening assembly according to claim 1, wherein the fastening screws (9) are preinstalled in a friction locked manner in breakthrough regions of the cover cap (10).

7. The fastening assembly according to claim 1, wherein a second wall thickness compensating plate (11) is integrally molded via a film hinge to the at least one wall thickness compensating plate (11) which is molded onto the cover cap (10) via a film hinge (12), the second compensating plate is clipped onto a side of the at least one wall thickness compensating plate (11) opposite to a catch pin (13) thereof.

8. A fastening assembly for a built-in refrigerator (3) on a side wall (2*a*) of a furniture body (2), comprising:

a hinge (5) having a hinge arm (6), which is fixable on a refrigerator side, a screw-on flange (7) having through holes (8) for fastening screws (9), wherein two of the fastening screws (9) pass through the through holes (8) of the screw-on flange (7), and are screwed into the side wall (2*a*) of the furniture body (2), and at least one wall thickness compensating plate (11), which is insertable if between the screw-on flange (7) and the side wall (2*a*), wherein the fastening screws (9) are preinstalled in a cover cap (10), and wherein the cover cap (10) is manufactured from plastic and is preinstalled on the screw-on flange (7) via plugging thereon.

9. The fastening assembly according to claim 1, wherein the cover cap includes catch lugs, undercuts or both such that the cover cap plugs onto the screw-on flange.

* * * * *